US005842911A

United States Patent [19]

Weber

[11] Patent Number: 5,842,911

[45] Date of Patent: Dec. 1, 1998

[54] METHOD OF MAKING PISTONS AND PISTON RODS AS WELL AS CYLINDERS FOR HYDRAULIC OR PNEUMATIC APPARATUS

[76] Inventor: Günter Weber, Hauptplatz 23, A-2474 Gattendorf, Austria

[21] Appl. No.: 583,116

[22] PCT Filed: Jul. 14, 1993

[86] PCT No.: PCT/AT93/00119

§ 371 Date: Jan. 16, 1996

§ 102(e) Date: Jan. 16, 1996

[87] PCT Pub. No.: WO95/02486

PCT Pub. Date: Jan. 26, 1995

[51] Int. Cl.[6] ..... B24B 1/00

[52] U.S. Cl. ..... 451/58; 451/51; 451/49; 451/66; 451/57

[58] Field of Search ..... 451/58, 51, 57, 451/59, 49, 66

[56] References Cited

U.S. PATENT DOCUMENTS

| | | | |
|---|---|---|---|
| 4,599,827 | 7/1986 | Goodwin | 451/57 |
| 5,643,054 | 7/1997 | Bach et al. | 451/51 |
| 5,674,111 | 10/1997 | Harada et al. | 451/49 |

FOREIGN PATENT DOCUMENTS

| | | | |
|---|---|---|---|
| 2159551 | 7/1973 | Germany | B44C 1/00 |
| 3344004 | 6/1985 | Germany | B24B 1/00 |
| 3636853 | 5/1987 | Germany | B23P 13/02 |

*Primary Examiner*—Robert A. Rose
*Assistant Examiner*—George Nguyen
*Attorney, Agent, or Firm*—Karl Hormann

[57] ABSTRACT

Method of making pistons and piston rods as well as cylinders for hydraulic and pneumatic apparatus, whereby a precision-finished cylindrical semi-finished article made of an aluminum alloy is hard-anodized at its sliding surface and whereby the hard-anodized article is rotated about its axis and the formed ceramic sliding surface layer thereof is treated by a plurality of successive grinding operations with two-dimensional grinding media of differing reducing grain size.

8 Claims, 1 Drawing Sheet

METHOD OF MAKING PISTONS AND PISTON RODS AS WELL AS CYLINDERS FOR HYDRAULIC OR PNEUMATIC APPARATUS

CROSS-REFERENCE TO RELATED APPLICATIONS

This application relates to International Application No.: PCT/AT93/00119 and was filed pursuant to 35 U.S.C. 1.371.

BACKGROUND OF THE INVENTION

Filed of the Invention

The invention in general relates to a method of making pistons and piston rods as well as cylinders for hydraulic or pneumatic apparatus and, more particularly, to a novel method of successively performing a plurality of surface treatment operations resulting in an exceedingly smooth surface.

It is known by hard-chromium plating to coat pistons for hydraulic or pneumatic cylinders with a layer of chromium. However, chrome plating has been found to be prone to deteriorate and in time leads to the formation of rust and rapid wear of the pistons and seals. It is also known by anodization to provide aluminum components with a wear-resistant surface coating.

Heretofore, hard-anodization of piston surfaces, for instance, has not been considered to yield satisfactory results because of the micro-porosity and corresponding roughness of the resultant surface which absolutely mitigate against its utilization as a sliding surface. As regards pistons and piston rods in particular, such a rough surfaces would damage the cylinder seals.

Attempts have repeatedly been made to reduce the roughness of the coating such as, for instance, by compressing and sealing of the pores in a hot water bath, or by grinding with a grinding powder. It has not been possible, however, to come close to the surface quality required for use with pistons or piston rods, as the case may be.

OBJECTS OF THE INVENTION

The invention is directed to providing a method which ensures long life of pistons or piston rods, as the case may be, and of cylinders of hydraulic or pneumatic apparatus. The method in accordance with the invention is characterized by hard-anodizing the sliding surface of a precision-finished semi-fabricated cylindrical component and by rotating the hard-anodized component about its axis and by treating the resultant sliding surface thereof to a plurality of successive grinding operations with two-dimensional grinding media of differing decreasing grain sizes, whereby each grinding operation is carried out until any dust formation ends and whereby buffing takes place during the final grinding operation until adherence of the two-dimensional grinding medium.

SUMMARY OF THE INVENTION

With the method in accordance with the invention, it has now become possible for the first time to manufacture pistons and piston rods as well as cylinders made of an aluminum alloy having a sliding surface with a roughness depth $R_t$ of 0.3 $\mu$m. Such a sliding surface smoothness avoids any possibility of seals deteriorating and ensures a substantially increased useful life as compared to conventional chrome-plated components.

The method in accordance with the invention makes it possible to provide uniform surface qualities in the most diverse kind of initial surfaces substantially regardless of their initial roughness.

It has been found to be particularly advantageous to execute five grinding steps with type P 100, P 150, P 280, P 400 and P 999 grinding webs, P 100 being a grinding web made with a sieve having 100 meshes per inch. These values are optimized; departure from these values will lead to a deterioration of surface quality.

A further optimization is obtained by rotating the hard-anodized component during the grinding operation at about 2,500 rpm, and by an engagement pressure of the grinding medium of about 50 N.

An especially long service life of the pistons and piston rods as well as of the cylinders results from using AlMgSi 1 alloy as the material for manufacturing the semi-fabricated component and from a depth of anodization of 50 to 60 $\mu$m.

BRIEF DESCRIPTION OF THE DRAWINGS

The method in accordance with the invention will now be described in further detail on the basis of an embodiment and a piston rod made in accordance therewith. In the description, reference will be made to the drawings, in which.

DETAILED DESCRIPTION OF THE PREFERRED EMBODIMENT

A cylindrical semi-fabricated component made of AlMgSi 1 alloy and measuring 500 mm in length and slightly more than 60 mm in diameter was clamped into a lathe and precision finished by a diamond bit to a diameter of 60 mm.

The surface of the precision finished semi-fabricated component was hard-anodized to a depth of 50 to 60 $\mu$m.

Thereafter, the hard-anodized component was again clamped into the lathe and rotated at a speed of 2,500 rpm. Five grinding operations were then sequentially carried out with corundum grinding webs, types P 100, P 150, P 280, P 400 and P 999, the latter being rouge paper. Type designation P 100 refers to a grinding web made with a sieve having 100 meshes per inch.

Each grinding web was mounted on a grinding block and was pushed by it into engagement with the rotating component with a thrust of 50 N and was moved axially thereof. Each of the first four grinding operations were carried on until dust formation ceased; and the final grinding operation which corresponds to a buffing operation was carried on until adherence of the grinding web.

Instead of a buffing web, any other two-dimensional grinding medium of appropriate grain size may, of course, be used.

The piston rod for a hydraulic cylinder made in this manner, having an aluminum alloy core and surface coating, displayed a sliding surface of excellent quality comparable to surfaces of hard-chrome plated piston rods.

Figure 1:
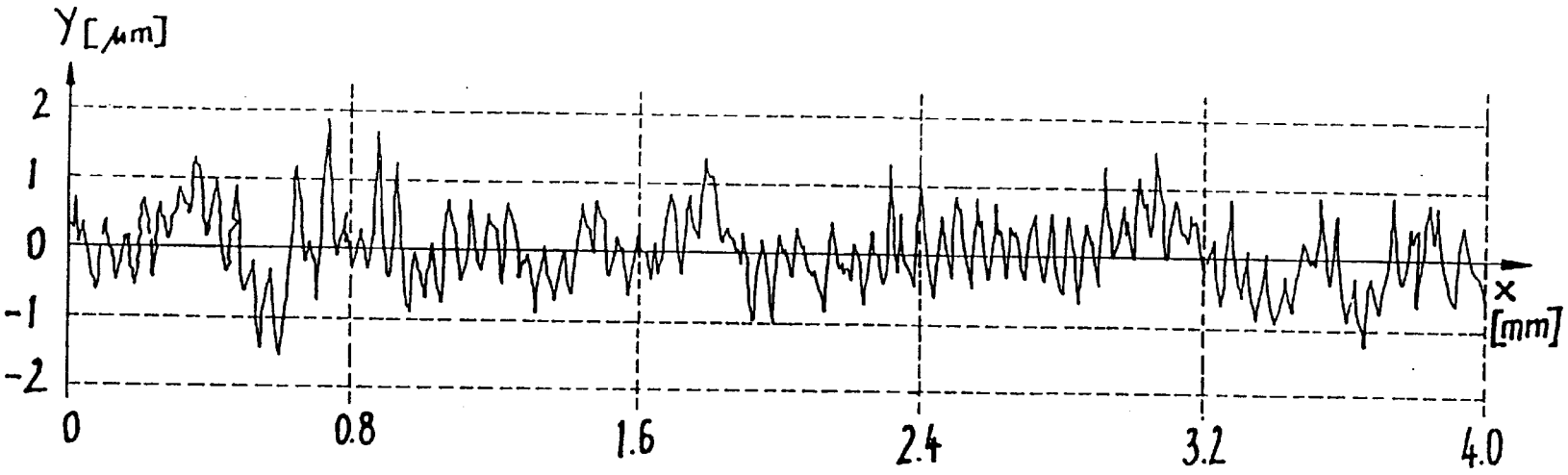
FIG. 1 depicts the surface roughness of a piston rod surface measured by a testing device before treatment.
Figure 2:
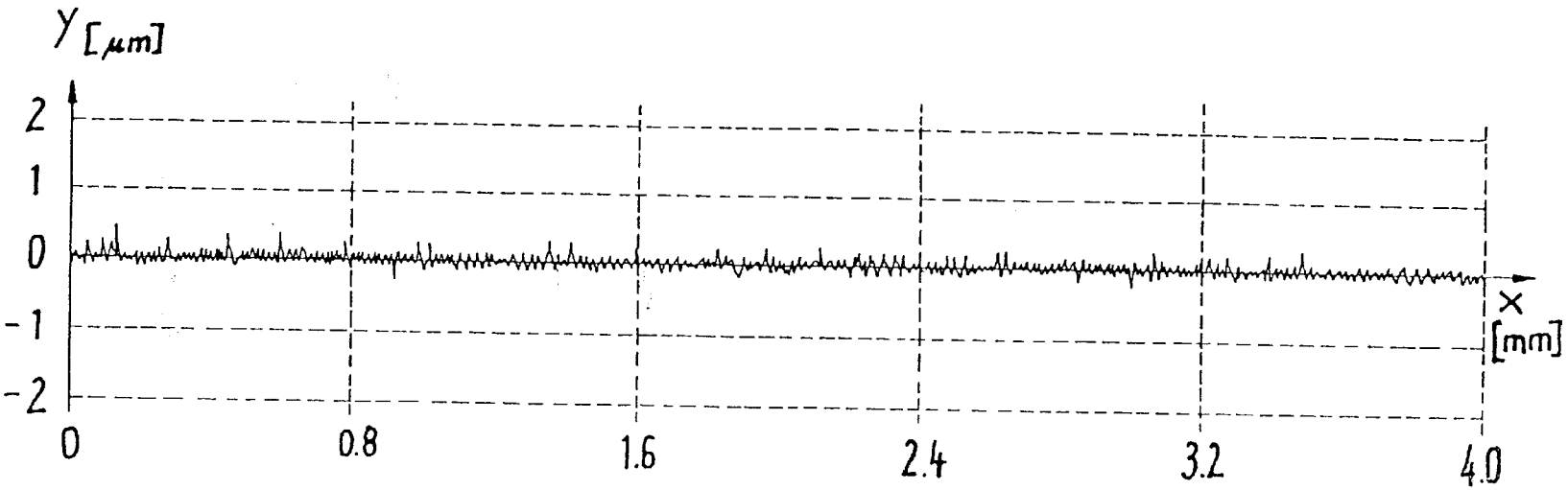
FIG. 2 depicts the surface roughness of the piston rod surface measured with the same testing device after treatment in accordance with the invention.

In FIGS. 1 and 2, the roughness profile Y is shown in $\mu$m superimposed on the roughness reference length X shown in mm. The total roughness reference length was 4 mm and was subdivided into sections of 0.8 mm each. A mathematic analysis based on the DIN norm, for the profile curve of FIG. 1, yielded the following DIN values:

| | |
|---|---|
| average roughness value $R_a$ | 0.4 $\mu$m |
| mean roughness depth $R_z$ | 2.5 $\mu$m |
| roughness depth $R_t$ | 3.4 $\mu$m. |

The analysis of the profile curve of FIG. 2 yielded the following DIN values:

| | |
|---|---|
| average roughness value $R_a$ | 0.05 $\mu$m |
| mean roughness depth $R_z$ | 0.3 $\mu$m |
| roughness depth $R_t$ | 0.3 $\mu$m. |

The depth of roughness of 0.3 $\mu$m obtained in this example is excellent for a sliding surface of a piston or piston rod, as the case may be, or of a cylinder, and prevents seals from being damaged.

It will be apparent that the method in accordance with the invention may be practiced manually as well as by a machine. Appropriately programmed NC machine tools equipped with grinding tools may, for instance, be used for practicing the invention with a machine. Such machines may automatically execute the mounting (clamping) operations and the changing of grinding webs. The grinding parameters, such as grinding pressure and duration, may be automatically controlled as functions of measuring values from suitable dust sensors.

What is claimed is:

1. A method of making an article of manufacture made of an aluminum alloy and provided with an elongate sliding surface of substantially cylindrical configuration, comprising the steps of:

hard-anodizing at least the elongate sliding surface;

rotating the hard-anodized elongate sliding surface about its axis;

subjecting the rotating elongate surface to at least one grinding operation with a first grinding web of predetermined grain size whereby dust is formed during at least a portion of the grinding operation;

terminating the grinding operation when dust formation ceases;

polishing the ground elongate sliding surface with a second grinding web of lesser grain size whereby a surface condition is gradually created between the elongate sliding surface and the second grinding web which causes the second grinding web to cling to the elongate sliding surface; and terminating the polishing when the surface condition has been created.

2. The method of claim 1, wherein the aluminum alloy used is AlMgSi 1.

3. The method of claim 2, wherein hard-anodizing is performed to a depth from between about 50 $\mu$m and 60 $\mu$m.

4. The method of claim 3, where a plurality of grinding steps is performed with grinding webs of successively finer grain size between the at least one grinding step and the polishing step.

5. The method of claim 4, wherein the first grinding step is performed with a type P 100 web made with a sieve having a mesh size of 100 meshes per inch and the plurality of grinding steps is performed in succession with types P 150, P 280 and P 400 grinding webs.

6. The method of claim 5, wherein the polishing step is performed with a type P 999 web (rouge paper).

7. The method of claim 6, wherein the elongate sliding surface is rotated at a speed of about 2,500 r.p.m.

8. The method of claim 7, wherein grinding is performed at a thrust of about 50 N.

* * * * *